United States Patent [19]

Chastain

[11] 3,977,138

[45] Aug. 31, 1976

[54] SPACE ENCLOSURE

[76] Inventor: Lemuel J. Chastain, 446 Prospect Ave., Brooklyn, N.Y. 11215

[22] Filed: Apr. 16, 1975

[21] Appl. No.: 568,450

[52] U.S. Cl. ..... 52/81; 52/DIG. 10

[51] Int. Cl.[2] ..... E04B 7/10

[58] Field of Search ..... 52/80, 81, DIG. 10; 35/46

[56] References Cited

UNITED STATES PATENTS

| | | | |
|---|---|---|---|
| 2,918,992 | 12/1959 | Gelsavage | 52/81 |
| 3,114,176 | 12/1963 | Miller | 52/81 |
| 3,255,556 | 6/1966 | D'Amato | 52/81 |
| 3,296,755 | 1/1967 | Chisholm | 52/81 |
| 3,304,669 | 2/1967 | Geschwender | 52/DIG. 10 |
| 3,392,495 | 7/1968 | Ahern | 52/81 |
| 3,660,952 | 5/1972 | Wilson | 52/DIG. 10 |
| 3,696,566 | 10/1972 | Langner | 52/DIG. 10 |
| 3,841,039 | 10/1974 | Farnsworth | 52/81 |
| 3,854,255 | 12/1974 | Baker | 52/DIG. 10 |

FOREIGN PATENTS OR APPLICATIONS

| | | | |
|---|---|---|---|
| 218,161 | 4/1961 | Austria | 52/81 |
| 13,481 | 1/1851 | United Kingdom | 52/81 |

OTHER PUBLICATIONS

*Order in Space* by Critchlon 1969 pages 20, 21, 35, 39, 92–95.

*Primary Examiner*—Price C. Faw, Jr.
*Assistant Examiner*—Henry Raduazo
*Attorney, Agent, or Firm*—Natter & Natter

[57] ABSTRACT

Space enclosures fabricated of relatively inflexible material, critically formed into a three dimensional shape which approximates to some degree the dome construction of common architectural form. Each of the enclosures representing the several embodiments of invention is comprised of a plurality of pieces, fabricated from material which not only has rigidity but sufficient thickness that must be taken into account at the juncture of adjoining pieces by determining the dihedral angles formed by the intersecting planes of their inside surfaces. This allows for the proper beveling of the edges of the construction members to establish the total angle at each intersection. The pieces, or construction members are actually planar members most of which are in triangular form. According to the invention, both the dihedral angles and the linear dimensions of the members are more easily calculated if the triangular construction members are restricted to an isosceles shape. Each edge of the construction members is tangent to the surface of an imaginary spherical shape at some predetermined point intermediate its terminal points, the sphere having the same center as the actual enclosure to be constructed. The building design according to the invention allows for a great variety of shapes and appearances, each of which may be considered as a separate embodiment of the claimed invention.

7 Claims, 9 Drawing Figures

SPACE ENCLOSURE

This invention relates to polyhedral space enclosures based on spherical shapes and the like.

According to the present invention, there is provided a space enclosure fabricated of a plurality of rigid or semi-rigid panel members which may be combined to form the enclosure in the shape of an approximate dome having a portion of a sphere as its imaginary basis. In practice, other shapes may be formed based on the sphere, but the various embodiments of invention which are of primary concern here assume the appearance of dome-like or hemispheric structures.

A basic concept underlying the final product resides in the fact of tangency at points on each edge between the ends of the panel edges with the surface of the concentric, imaginary sphere which affords the mathematical basis as well as prototype for the finished structure. Such concept contrasts with that which lies behind the so-called geodesic dome structures described, for example, in U.S. Pat. No. 2,682,235 which depend upon the creation of grid-like supporting structure the individual chord components of which are oriented with respect to great circle arcs of the concentric sphere, the chord components normally intersecting the sphere at their end as opposed to intermediate points.

The individual panel members of the instant structure are frequently formed in the shape of isosceles triangles for ease of computation as opposed to the equilateral triangle concept underlying the previously patented structures. However, the use of panels shaped as isosceles triangles is not a requirement here; other triangular and nontriangular shapes, e.g. trapezoidal, may be employed in the formation of the individual panel members so long as the concept of intermediate point tangency between the side edges of the panels and the imaginary, concentric sphere is preserved.

One object of the invention is to provide a space enclosure the production of which involves a minimum of waste of construction materials.

Another object of the invention is to provide a space enclosure of relatively simple design and construction.

A further object of the invention is to provide a space enclosure based on architectural concepts permitting of a variety of design and differences in final appearance.

Other objects and advantages of the invention may be appreciated on reading the following description of two of its embodiments taken in conjunction with the accompanying drawings, in which.

Figure 1:
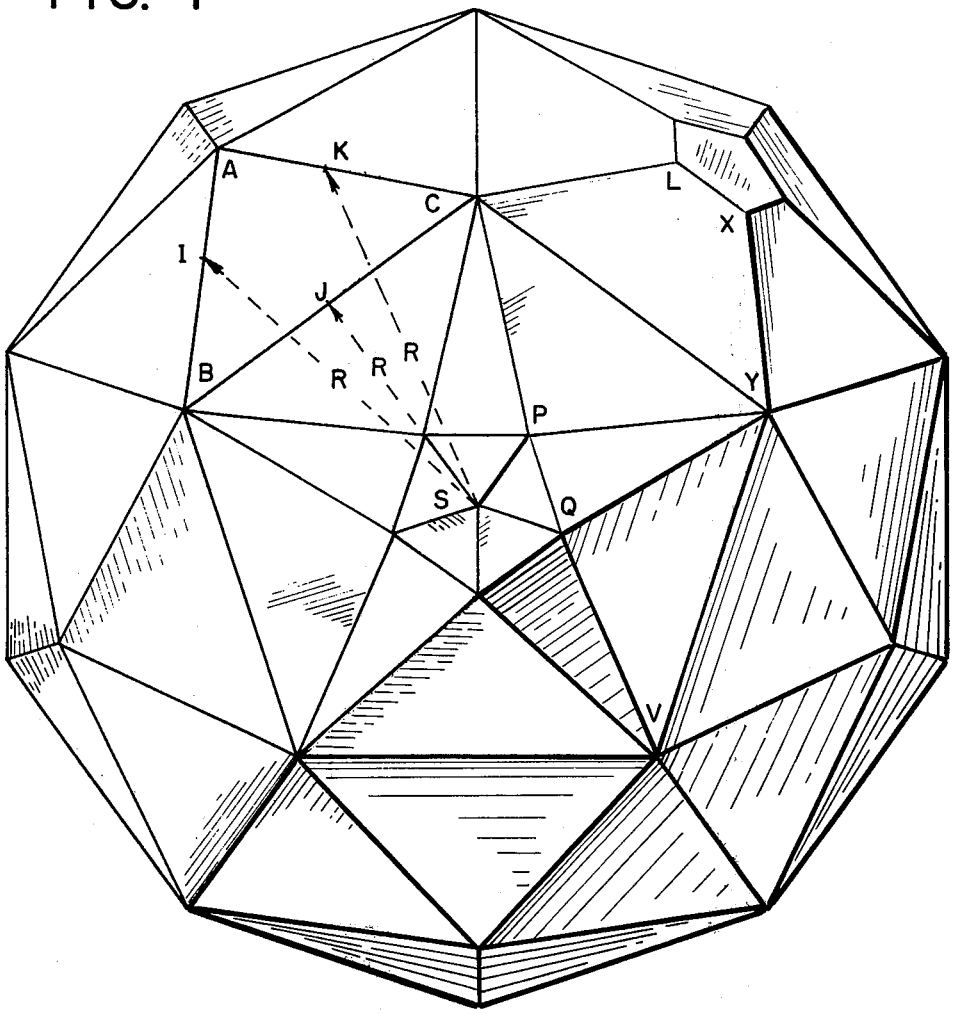
FIG. 1 is a plan view of one embodiment of the invention.

Referring to the drawings, the structure shown in FIG. 1 is based upon pentagonal-dodecahedron. To show variety, and to avoid too much symmetry, three different divisions of the regular-pentagonal faces are shown. Most of these faces have been divided into five congruent isosceles triangles as shown, for example, in the upper left. Triangle A-B-C is one of these, with the side B-C being an edge of the original dodecahedron. At the upper right of FIG. 1 are five isosceles trapezoidal faces grouped about a regular pentagonal face. These six planar members are produced by truncation of the penta-pyramidal portion of the structure which is shown in the upper left hand corner of the drawing.

At the center of FIG. 1 is an entirely different division of the dodecahedral face. At this point it should be mentioned that all lines shown in this division of the pentagonal-face are tangent to a common imaginary sphere, and thus greater sphericity is obtained than with the original dodecahedral shape. At the center of FIG. 1 are five isosceles triangles, forming a small pentagonal-pyramid. P-Q is one side of the base. Upon each of these base sides is another isosceles triangle; of which P-Q-Y is one. Between any two of this latter type is a different shaped isosceles triangle exemplified by Q-V-Y. The relationship between these two different groups of congruent triangles is that their common side Y-Q has a length equal to one half of the sum of the lengths of base-side P-Q and base-side V-Y.

Dotted lines from S to I, J, and K are radii R of an imaginary sphere which is concentric with this polyhedral shape. The sides A-B, B-C, and C-A are tangent to such a sphere at points I, J, and K on the sphere respectively.

All other edges shown in this embodiment are also tangent to the same sphere. Isosceles triangular faces are tangent to the imaginary sphere at the midpont of their bases, but not at the midpoint of their other two sides.

Figure 2:
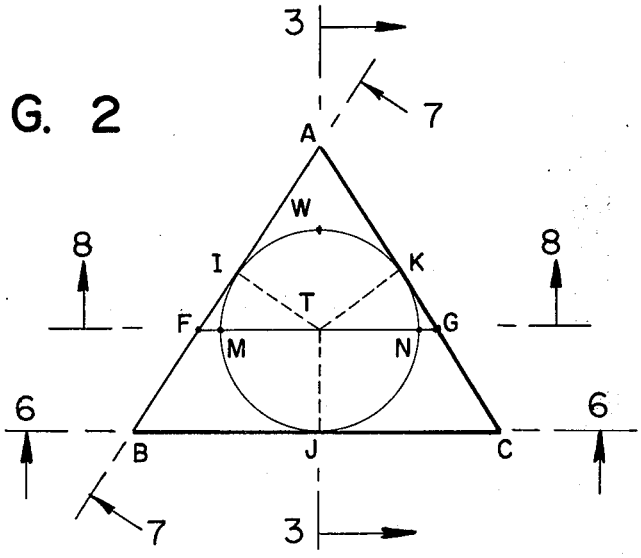
FIG. 2 is a geometric view of an isosceles triangle employed as a basis for constructing panel members.

FIG. 2 shows a circle inscribed on the surface of an isosceles planar face which passes through the three points of tangency I, J, and K, with the imaginary sphere. The center of this circle T is a point the normal to which passes through the center of the sphere S. The point W on the intersection of the inscribed circle with the line from A to T provides a point for truncation shown in the trapezoidal face L-X-Y-C disclosed in FIG. 1. Such a point would lie at the midpoint of the side L-X.

Figure 3:
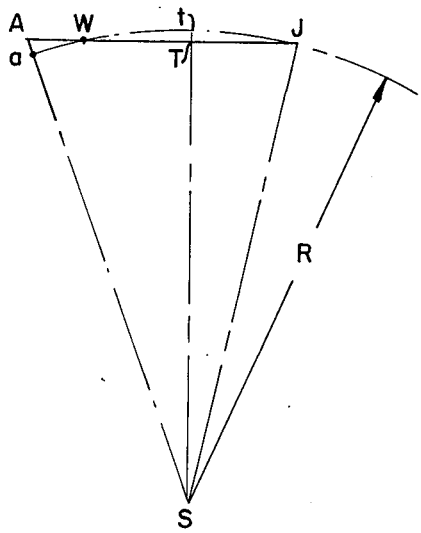
FIG. 3 is a section taken on the line 3—3 of FIG. 2 related to the center of an imaginary sphere.

It is shown in FIG. 3 that the point T lies within the sphere and point A is exterior thereof. Point W is shown to be on the sphere. R is the radius of the imaginary sphere having a center S. R intersects the sphere at point *t* within spherical triangle *a-b-c* which corresponds to point T on the planar triangle A-B-C.

Figure 4:
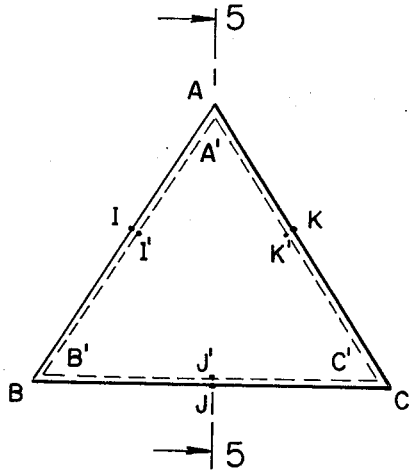
FIG. 4 is a plan view of a construction panel.

As shown in FIG. 4 the construction panel member has thickness with points on the top surface being A, I, B, J, C, and K while corresponding points on the lower surface being labelled A′, I′, B′, J′, C′, and K′ being radially disposed from their respective points on the upper surface.

Figure 5:
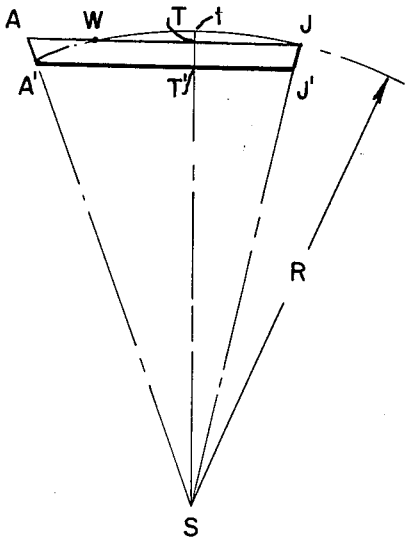
FIG. 5 is a sectional view of the panel taken on the line 5—5 of FIG. 4.

There is shown in FIG. 5 the bevel angle A J J′ of the trapezoidal figure A, J, J′, and A′. Since J is on the edge B-C and J′ on the edge B′-C′ the bevel angle of this edge of the panel may be defined as the complement of the angle between the normal S-T′-T and the line S-J′-J where S is the center of the imaginary and concentric sphere.

Figure 6:
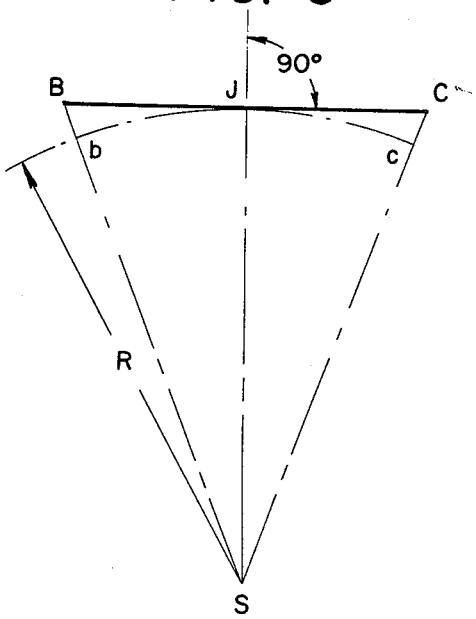
FIG. 6 is a section through the imaginary sphere taken on the line 6—6 of FIG. 2.

As shown in FIG. 6 the end points of the triangular panels lie above the imaginary sphere the terminal points B and C being radially projected from points *b* and *c* lying on the sphere.

Figure 7:
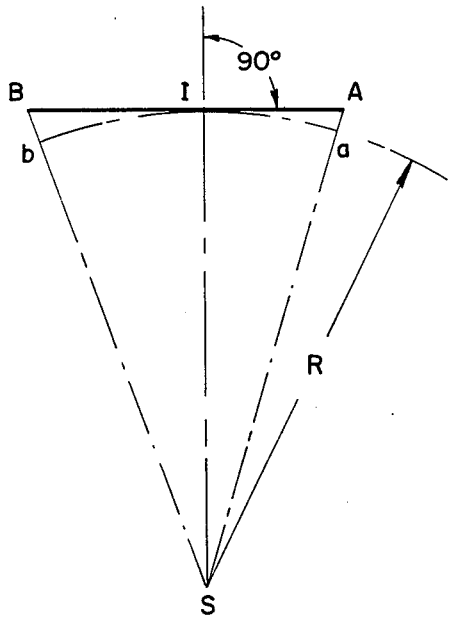
FIG. 7 is a section through the imaginary sphere taken on the line 7—7 of FIG. 2.

It can be seen in FIG. 7 that point A lies closer to the center S than does point B illustrating further that the tangency point I is not the midpoint of A-B.

Figure 8:
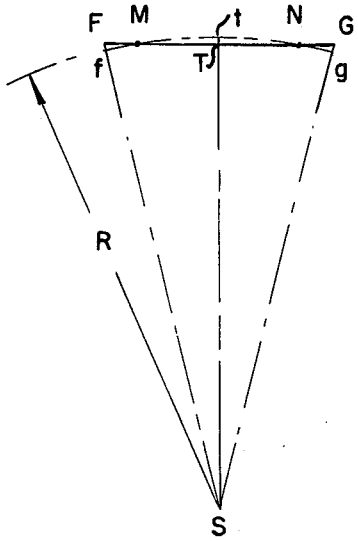
FIG. 8 is a section taken through the sphere taken along the line 8—8 of FIG. 2.

As shown in FIG. 8 the point T as the center of the inscribed circle shown in FIG. 2 lies below the surface of the imaginary sphere having a center S and corresponds to point *t* which lies on the spherical surface. The points M and V are on the intersection of the section line F-G and the inscribed circle of the triangular member A-B-C, the circle lying on both the surface of the imaginary sphere and the planar surface of the member. The points F and G are radial projections of the Spherical radii S*f* and S*g*, respectively.

Figure 9:
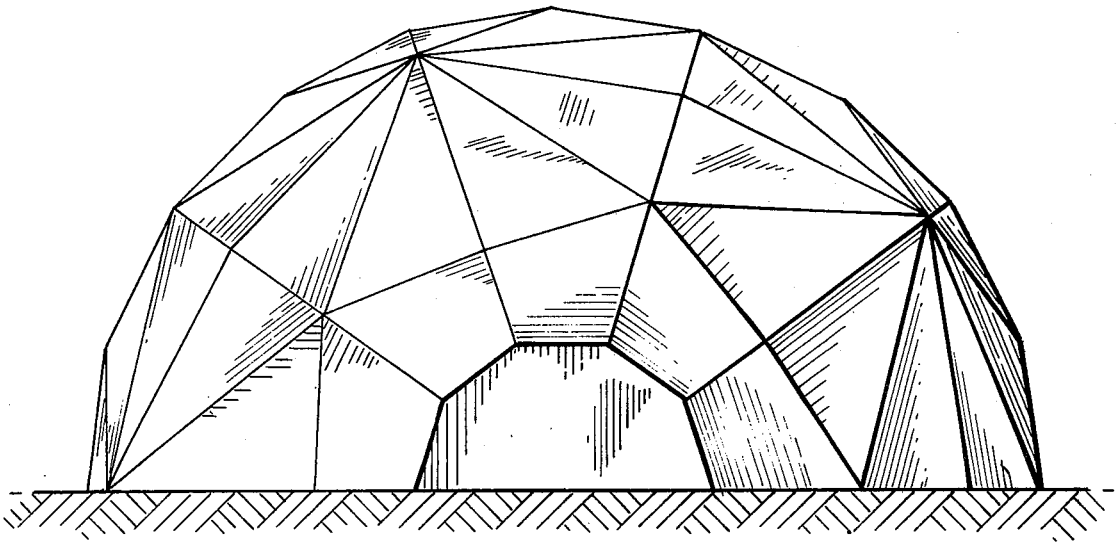
FIG. 9 is an elevation view of a modified embodiment of the invention showing an enclosure derived from a hemisphere.

The enclosure shown in FIG. 9 is also based on the regular pentagonal dodecahedron. It is entirely different from that embodiment found in FIG. 1. In FIG. 9 the isosceles triangle has not been resorted to. All triangles shown are scalene, emphasizing the versatility of this invention. Five of these triangles have been truncated to provide a vertical wall for a doorway. This appears at the front-center on the drawing. While the isosceles triangle is the easier to work with, FIG. 9 is presented to show that the invention is able to incorporate any scalene triangle if necessary.

The fact that FIG. 9 is composed of only two different triangles, one set being the mirror-image of the other, is not meant to imply that this simplicity is possible with any scalene triangle. In most cases, incorporating even one scalene triangle will necessitate adapting adjacent planar members.

The panels are triangular shaped or may have other shapes. In any event, it is required according to the inventive concept that the panels have a point of tangency with the imaginary sphere at some point between the ends of their side edges. In addition both the end points and points of tangency of adjacent side edges of adjacent panels have to be coincident. Further, if the panels are shaped as isosceles triangles and have different length bases, they may be placed adjacent along their non-base sides, but only if the average of the bases is equal to the length of the four other equal sides.

The angle formed by the plane, interior surfaces of the adjacent panel members is a dihedral angle which is the sum of two jointed, bevelled edges. The sum is determined on computing each bevel angle by finding, for example, each arc cosine based on the radius of the assumed sphere and the distances from the point of tangency of the panel side to the point on each of the two panels through which a radius of the imaginary sphere passes as a normal thereto. However, once the dihedral angle is determined by summing the two bevel angles of the joined sides, the bevel angles may be changed as long as the total of the two bevel angles is that of the desired dihedral angle.

Various other embodiments of the invention may be effected by persons skilled in the art without departing from the scope and principle of the invention as defined in the appended claims.

What is claimed is:

1. A domelike space enclosure comprised of a plurality of polygonal planar panel members having at least one non-regular polygon and at least one other shaped polygon which is not the mirror image of the nonregular polygon, each of said panel members having a base side and at least two other sides, said panel members being adapted for assembly concentrically spaced about and approximating a spherical surface, said panel members being positioned for tangential intersection with said spherical surface at an intermediate point along each of the base and other sides of the respective panel members, said intermediate points defining an inscribed circle within each polygonal panel member with said circle being coincident with the spherical surface, each of said respective panel members having a thickness dimension with an edge thickness along the base side and other sides thereof being bevelled to provide companion mating edge surfaces between contiguous panels and forming a dihedral angle between said panels, said mating edge surfaces being coincident with a great circle plane passing through said spherical surface and tangent to the inscribed circle at said intermediate points whereby the linear dimensions of the sides and the dihedral angle between adjacent panel members are determinable for accurate interfitting between adjacent panel members thus effecting a weathertight seal and maximum structural rigidity.

2. A domelike space enclosure as claimed in claim 1 wherein the polygonal panel members are triangular in shape having two sides of equivalent linear dimension and a base side of a different linear dimension with the spherical surface intersecting the base side at its midpoint.

3. A domelike space enclosure as claimed in claim 2 wherein the polygonal panel members are in the shape of an isosceles triangle with the spherical surface intersecting each of the equivalent linear dimension sides at a point dividing said sides into two unequal length segments.

4. A domelike space enclosure as claimed in claim 1 wherein the base side edge surface and all other side edge surfaces define bevel angles of equal magnitude.

5. A domelike space enclosure as claimed in claim 1 including a regular polygonal panel member wherein the base side and all other sides are of equivalent linear dimension and each of the respective side edge surfaces defines a bevel angle of equal magnitude.

6. A domelike space enclosure as claimed in claim 1 wherein the planar panel members are comprised of scalene triangles with each of the respective side edge surfaces defining a bevel angle of equal magnitude.

7. A domelike space enclosure as claimed in claim 1 wherein a bevel angle is defined as the complement of the angle formed within a right triangle between one leg defined by the radius of said spherical surface extending through the center of said inscribed circle and being perpendicular to the planar panel member at said point of intersection with the panel member, and the hypotenuse defined by another radius lying within the said great circle plane being coincident with the bevel surface and extending to the intermediate intersection point between a side of said panel member and said spherical surface.

* * * * *